US011774052B2

(12) United States Patent
Yang et al.

(10) Patent No.: US 11,774,052 B2
(45) Date of Patent: Oct. 3, 2023

(54) HIGH-EFFICIENCY LINEAR LIGHT SOURCE FOCUSED STRIP LAMP

(71) Applicants: Self Electronics Co., Ltd., Zhejiang (CN); Wanjiong Lin, Zhejiang (CN); Self Electronics USA Corporation, Norcross, GA (US)

(72) Inventors: Jun Yang, Zhejiang (CN); Kai Xu, Zhejiang (CN); Zuping He, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 18/045,277

(22) Filed: Oct. 10, 2022

(65) Prior Publication Data

US 2023/0111995 A1 Apr. 13, 2023

(30) Foreign Application Priority Data

Oct. 11, 2021 (CN) ..... 202111179350.5

(51) Int. Cl.
*F21S 4/28* (2016.01)
*F21V 5/04* (2006.01)
(Continued)

(52) U.S. Cl.
CPC ..... *F21S 4/28* (2016.01); *F21V 5/007* (2013.01); *F21V 5/04* (2013.01); *F21V 7/005* (2013.01);
(Continued)

(58) Field of Classification Search
CPC . F21V 5/04; F21V 7/005; F21V 5/008; F21V 7/0091; F21S 4/20; F21S 4/28
See application file for complete search history.

(56) References Cited

U.S. PATENT DOCUMENTS 11,118,758 B1 * 9/2021 Greenspan ..... F21V 5/045
2012/0140461 A1 * 6/2012 Pickard ..... F21V 7/0091 362/225

(Continued)

FOREIGN PATENT DOCUMENTS

CN 110454700 A * 11/2019 ..... F21S 4/20

OTHER PUBLICATIONS

Xu et al., "Optical assembly of illuminating lamp and linear-light-source illuminating lamp", Nov. 15, 2019, Espacenet, https://worldwide.espacenet.com/patent/search/family/067085523/publication/CN110454700A?q=pn%3DCN110454700A (Year: 2019).*

*Primary Examiner* — Tracie Y Green
*Assistant Examiner* — Michael Chiang
(74) *Attorney, Agent, or Firm* — Wang Law Firm, Inc.

(57) ABSTRACT

A high-efficiency linear light source focused strip lamp has a strip lamp frame, a strip lamp plate provided on the strip lamp frame, a condensing lens arranged above the light emitting direction of the light-emitting chip, and a strip lamp cover connected to the strip lamp frame and located above the condensing lens; the strip lamp cover is provided with a convex lens array that visually stretches the light-emitting chip along a length direction. The high-efficiency linear light source focused strip lamp performs light distribution through the concentrating lens in the vertical length direction, and achieves high-efficiency sweeping function, and in the longitudinal direction, the light-emitting chip is performed visually stretching by the convex lens arrays on the strip lamp cover, thus achieving the effect of the line light source, solves the original glare problem without affecting the efficiency.

10 Claims, 7 Drawing Sheets

(51) Int. Cl.

| | |
|---|---|
| ***F21V 5/00*** | (2018.01) |
| ***F21V 7/00*** | (2006.01) |
| *F21Y 115/10* | (2016.01) |
| *F21Y 103/10* | (2016.01) |

(52) U.S. Cl.
CPC ..... *F21V 5/008* (2013.01); *F21V 7/0091* (2013.01); *F21Y 2103/10* (2016.08); *F21Y 2115/10* (2016.08)

(56) References Cited

U.S. PATENT DOCUMENTS

| | | | | |
|---|---|---|---|---|
| 2018/0142846 | A1* | 5/2018 | Liu | A47B 97/00 |
| 2018/0267223 | A1* | 9/2018 | Rodgers | G02B 6/003 |
| 2019/0162402 | A1* | 5/2019 | Ji | F21V 33/0044 |
| 2020/0141564 | A1* | 5/2020 | Tsai | F21V 21/088 |
| 2020/0232617 | A1* | 7/2020 | Kim | F21S 8/081 |
| 2021/0341123 | A1* | 11/2021 | Mototsuji | F21S 41/322 |

* cited by examiner

HIGH-EFFICIENCY LINEAR LIGHT SOURCE FOCUSED STRIP LAMP

RELATED APPLICATION

This application claims priority to a Chinese Patent Application No. CN 202111179350.5, filed on Oct. 11, 2021.

FIELD OF THE TECHNOLOGY

The present invention relates to the field of lighting techniques, particularly a high-efficiency linear light source focused strip lamp.

BACKGROUND

In the context of energy conservation and environmental protection, LED lamps are increasingly used in the field of home and commercial lighting because of their high light efficiency and good light concentration performance. In recent years, both home and abroad have anti-glare standards for indoor lamps, and the European Union has strict anti-glare standards, that is, UGR<19 or even lower. In 1995, the International Lighting Commission put forward the concept of anti-glare of lamps, and took UGR as an indicator to evaluate the uncomfortable glare of indoor lighting environment.

There are many indoor lighting LED lamps, such as LED tubes. In order to avoid the light is too strong to give a person visual sense of vertigo, lamp covers often use translucent material, the LED point light source is expanded into surface light, increasing the lighting surface, eliminate the glare, sublimation visual effect. The light emitted by the light source cannot be effectively used, resulting in less effective lighting, and the illumination angle is not easy to control, and it is difficult to achieve the lighting effect requirements of UGR<19 in indoor lighting. In addition, color difference and blue light phenomenon will also occur, which is harmful to human eyes.

Now, few LED lamps can meet the anti-glare requirement in indoor lighting. At present, the common anti-glare panel light in the industry is to add a grid in front of the panel light to block the light from large angles. A quite part of the light emitted by the light source cannot be used for efficient use. It often loses more than half of the power, the structure is complex, and the energy saving effect is not ideal.

BRIEF SUMMARY THE TECHNOLOGY

In view of this, the present invention provides a high-efficiency linear light source focused strip lamp to solve the above technical problems.

A high-efficiency linear light source focused strip lamp, comprises

- a strip lamp frame,
- a strip lamp plate, provided on the strip lamp frame, and a plurality of light-emitting chips disposed at intervals in the longitudinal direction are provided on it;
- a condensing lens, arranged above the light emitting direction of the light-emitting chip, and the light emitting angle of the light-emitting chip is reduced in the plane of the vertical length direction;
- and a strip lamp cover, connected to the strip lamp frame and is located above the condensing lens;
- the strip lamp cover is provided with a convex lens array that visually stretches the light-emitting chip along a length direction.

- advantageously, a cross section of the strip lamp cover is a curved shape, and each convex lens in the convex lens array is a strip-shaped lens extending along the curved shape.
- advantageously, the convex lens array is disposed on an inner surface or outer surface of the strip lamp cover.
- advantageously, one side of the condensing lens away from an irradiation surface is provided with a strip reflective portion that reflects a light leakage to an opposite side of the condensing lens.
- advantageously, the strip reflective portion adopts a white reflective surface.
- advantageously, the strip reflective portion is arranged between the strip lamp plate and the strip lamp cover.
- advantageously, one side of the strip reflective portion toward the condensing lens is provided with a card slot, and the condensing lens is provided with a block that cooperates with the card slot.
- advantageously, the strip reflective portion and the strip lamp cover are molded and manufactured by a two-color extrusion process.
- advantageously, the condensing lens is a strip lens.
- advantageously, the condensing lens comprises a total reflection surface provided on both sides and a light inlet surface and a light outlet surface disposed between two total reflection surfaces.

The length direction is the length direction of the strip lamp.

The technical effects of the present invention:

The high-efficiency linear light source focused strip lamp of the present invention performs light distribution through the concentrating lens in the vertical length direction, and achieves high-efficiency sweeping function, and in the longitudinal direction, the light-emitting chip is performed visually stretching by the convex lens arrays on the strip lamp cover, thus achieving the effect of the line light source, solves the original glare problem without affecting the efficiency.

BRIEF DESCRIPTION OF THE DRAWINGS

Embodiments of the present invention will be described below with reference to the drawings, in which.

DETAILED DESCRIPTION OF THE INVENTION

Figure 1:
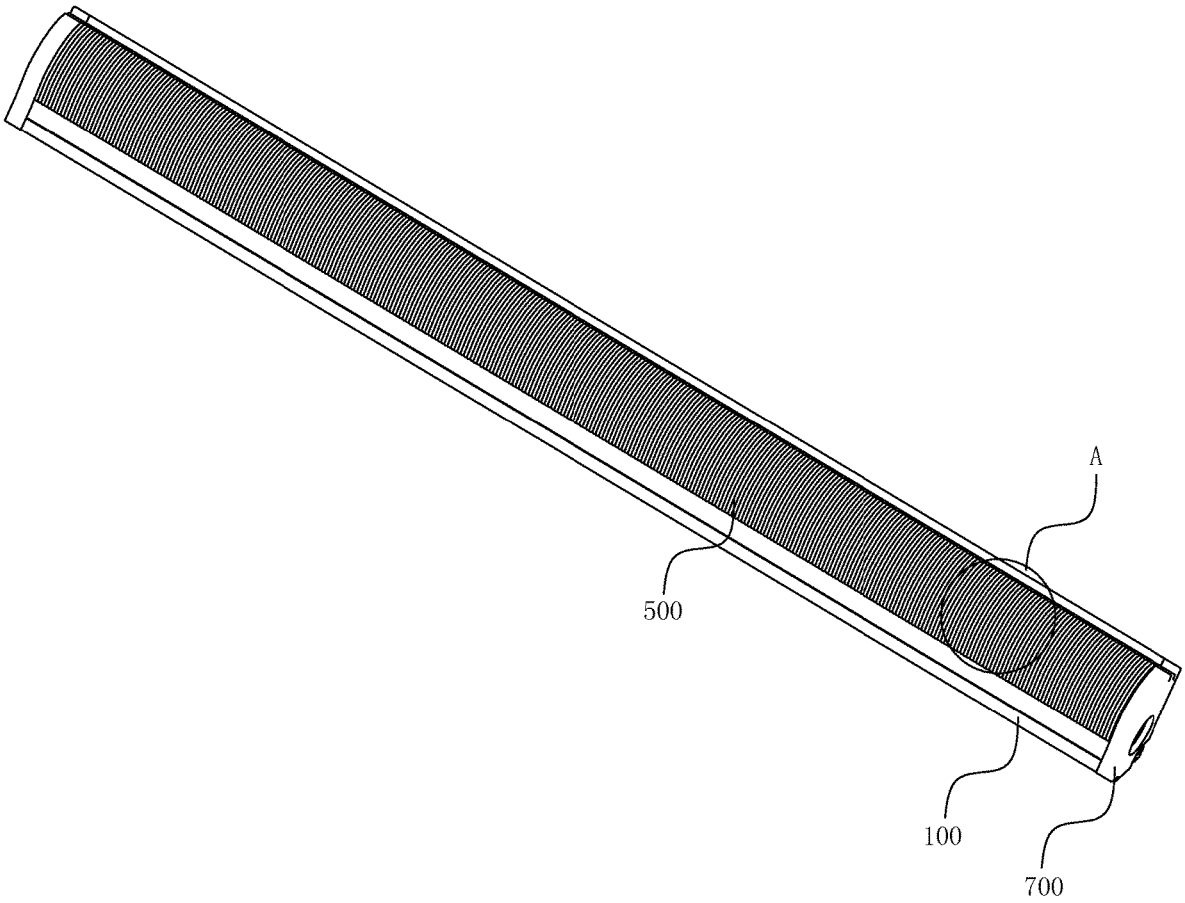
FIG. 1 is a schematic structural diagram of a high-efficiency linear light source focused strip lamp of the present invention.
Figure 2:
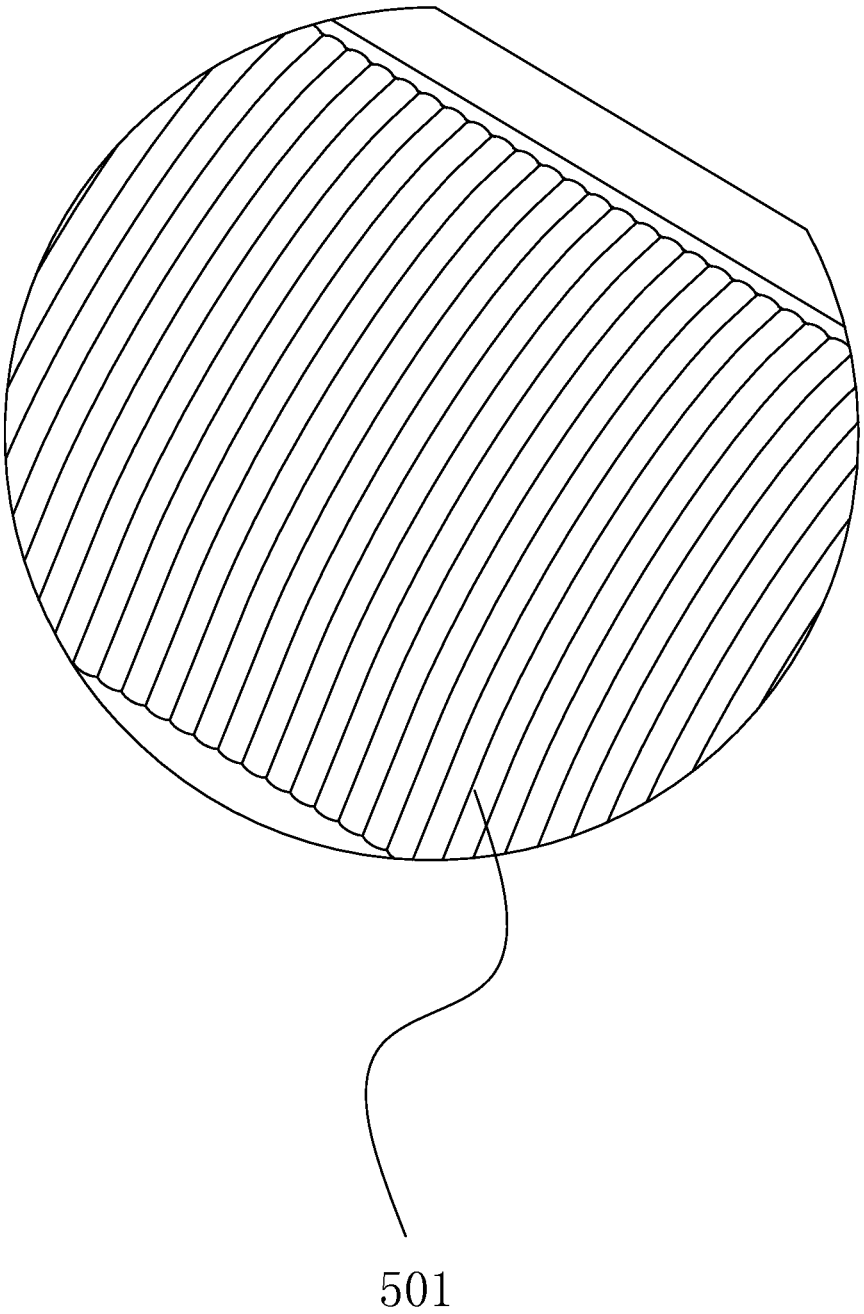
FIG. 2 is an enlarged view of the part A portion shown in FIG. 1.
Figure 3:
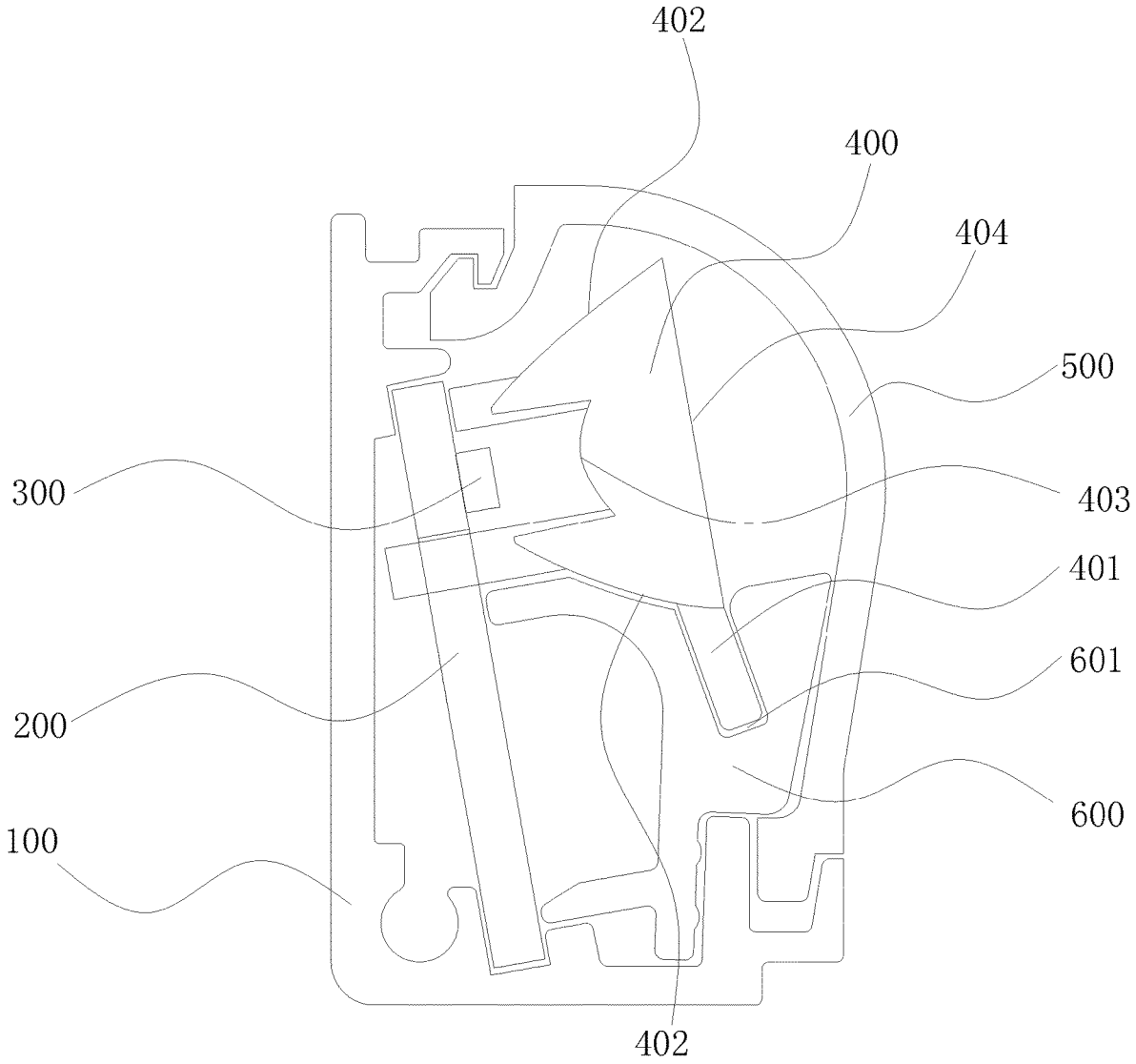
FIG. 3 is a cross-sectional view of a high-efficiency linear light source focused strip lamp according to an embodiment of the present invention.
Figure 4:
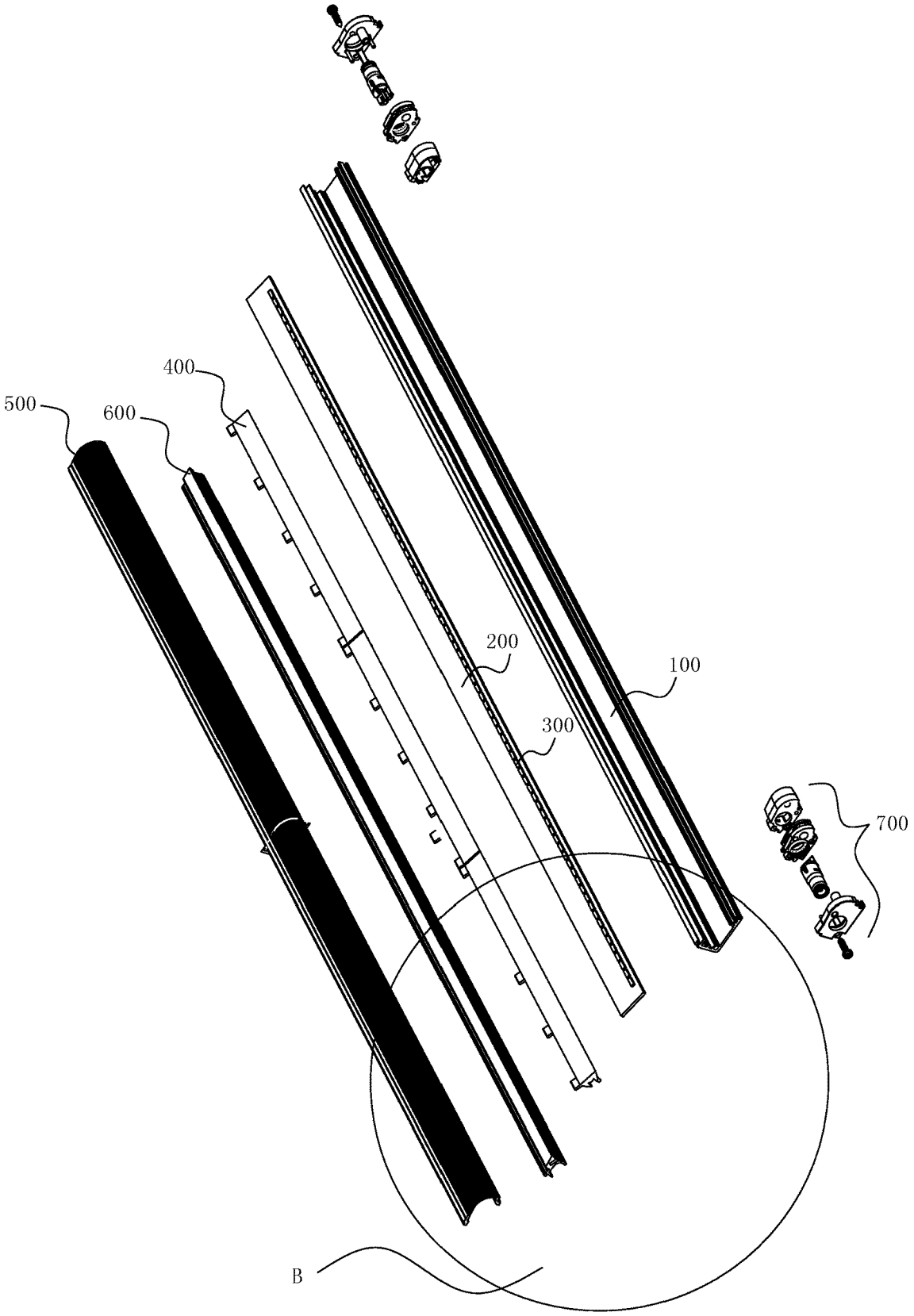
FIG. 4 is an exploding of a high-efficiency linear light source focused strip lamp in an embodiment of the present invention.
Figure 5:
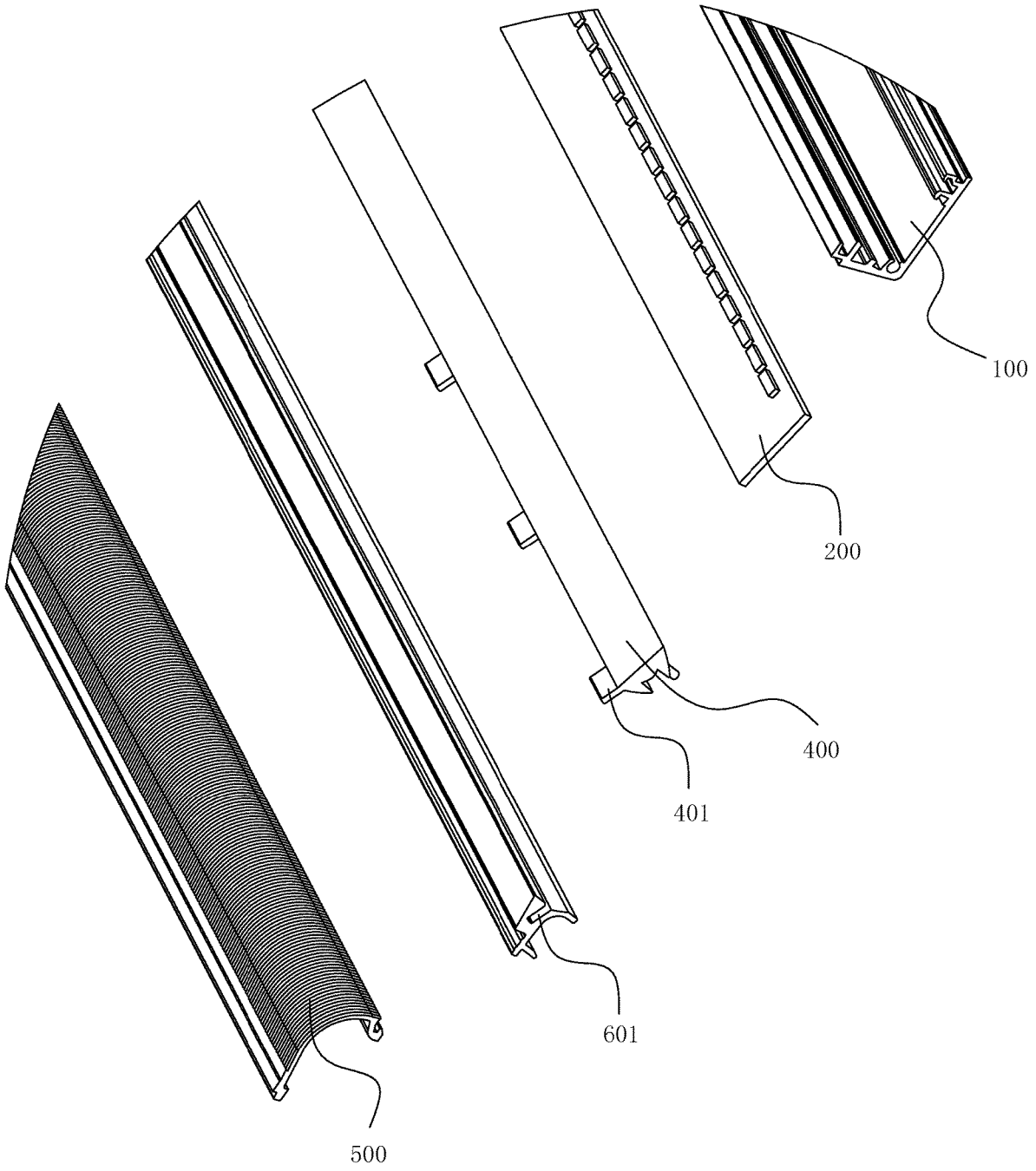
FIG. 5 is an enlarged view of the part B shown in FIG. 4.

The specific embodiments of the present invention will be described in further detail below based on the drawings. It should be understood that the description of the embodiments of the present invention is not intended to limit the scope of the invention.

As shown in FIG. 1 to FIG. 5, the high-efficiency linear light source focused strip lamp of the present embodiment includes a strip lamp frame 100, a strip lamp plate 200, a condensing lens 400, and a strip lamp cover 500. The strip lamp plate 200 is provided on the strip lamp frame 100, and a plurality of light-emitting chips 300 disposed at intervals in the longitudinal direction are provided on it; the condensing lens 400 is arranged above the light emitting direction of the light-emitting chip 300, and the light emitting Angle of the light-emitting chip 300 is reduced in the plane of the vertical length direction; the strip lamp cover 500 is connected to the strip lamp frame 100 and is located above the condensing lens 400.

The light-emitting chip 300 according to the present invention refers to an electroluminescent material, and an LED chip is currently common and efficiently.

The above structure is a common structure of a strip lamp having a sweeping function, wherein the light emitting Angle of the light-emitting chip 300 is reduced by the condensing lens 400, and the direction of the strongest light and the irradiation surface are set to a certain Angle, the sweeping effect can be obtained, and the light is uniform and the irradiation range is large.

The connection mode between the strip lamp frame 100, the strip lamp plate 200, and the strip lamp cover 500 is a conventional way, using the form of clip or plug, etc., which is not described here.

Further, the lamp also includes an end cap assembly 700 disposed at both ends, which is not the focus of the present invention and it will not be described herein.

In this embodiment, the strip lamp cover 500 is provided with a convex lens array 501 that visually stretches the light-emitting chip 300 along a length direction. The arrangement of the convex lens array 501 can let the light-emitting chip 300 on the vision stretching on the length direction. The dimming of the present invention is in the vertical length direction, and there is no need to light in the longitudinal direction, so it changes the imaging of the light emitting chip 300 through the convex lens array 501 but does not affect the light distribution, the implementation of line source at the same time, do not affect the light efficiency.

The length direction of the present invention is the length direction of the strip lamp.

The convex lens array 501 is disposed on the outer surface of the strip lamp cover 500, or in the inner surface, and it is easier manufacturing when provided in the outer surface.

In order to make more light out, the cross section of the strip lamp cover 500 is a curved shape, and each convex lens in the convex lens array 501 is a strip-shaped lens extending along an arc. The radius of the convex lens can be adjusted as needed to achieve the imaging of the adjacent two light-emitting chips 300 connect.

In order to further increase the light efficiency, one side of the condensing lens 400 away from the irradiation surface is provided with a strip reflective portion 600 that reflects the light leakage to the opposite side of the condensing lens 400. When the strip lamp of the present invention is in use, since the arrangement of the concentrating lens often leads to the area in front of the lamp don't get enough light, therefore, we set a strip reflective portion 600 on the side of the condensing lens 400 away from the radiation surface, which reuses some of the original waste of the leak and makes it reflected to the front of the strip lamp, making the light more uniform.

In order to improve the light uniformity, the strip reflective portion 600 of the present embodiment adopts a white reflective surface. The diffuse reflection produced by the white reflective surface, compared with the specular reflection is not easy to form uneven spots.

In order to improve the reflection efficiency and reflect more light leakage, in this embodiment, the strip reflective portion 600 is arranged between the strip lamp plate 200 and the strip lamp cover 500. Light leakage mainly occurs at the position of the light-emitting chip 300 and the condensing lens 400, and the strip reflective portion 600 can reflect these light leakage very well.

In order to facilitate mounting and fixing, one side of the strip reflective portion 600 toward the condensing lens 400 is provided with a card slot 601, and the condensing lens 400 is provided with a block 401 that cooperates with the card slot 601. Generally, when fixing the condensing lens 400, a fixed connection structure needs to be set between the strip lamp plate 200 and the condensing lens 400, which will become complex. A card slot is set on the strip reflective portion 600 to fix one side of the condensing lens 400, which reduces the setting of locking components and is more convenient for disassembly and replacement.

In order to facilitate manufacturing and installation, in the present embodiment, the condensing lens 400 is a strip lens.

The condensing lens can reduce the light outlet Angle of the light-emitting chip 300 to improve the light intensity near the optical axis, and the embodiment is more. In this embodiment, in order to improve the light efficiency, the condensing lens 400 includes a total reflection surface 402 provided on both sides and an light inlet surface 403 and an light outlet surface 404 disposed between the two total reflection surfaces 402. The light inlet surface 403 can also be set up as a concentrating convex lens, further increasing the efficiency. Further, the strip reflective portion 600 is attached to a total reflection surface 402 of the condensing lens 400.

Figure 6:
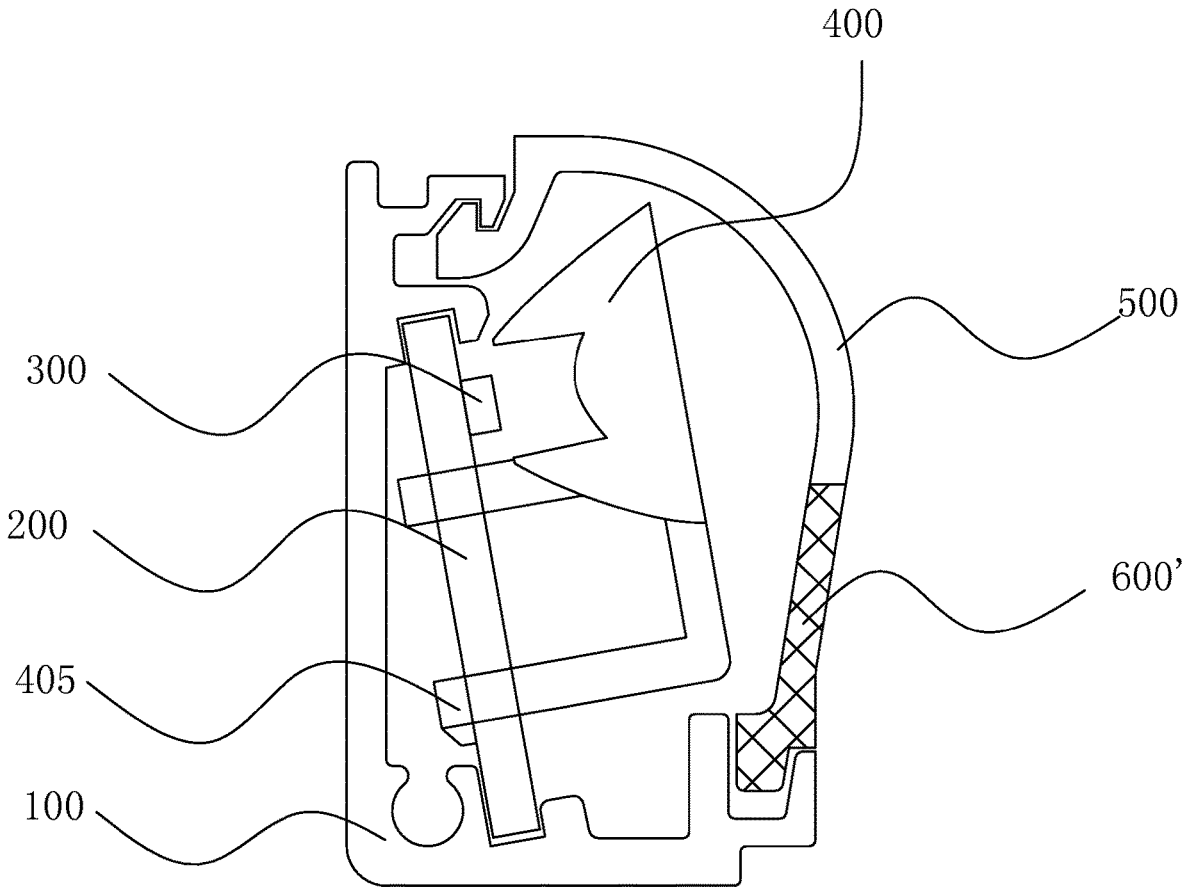
FIG. 6 is a cross-sectional view of a high-efficiency linear light source focused strip lamp for another embodiment of the present invention.
Figure 7:
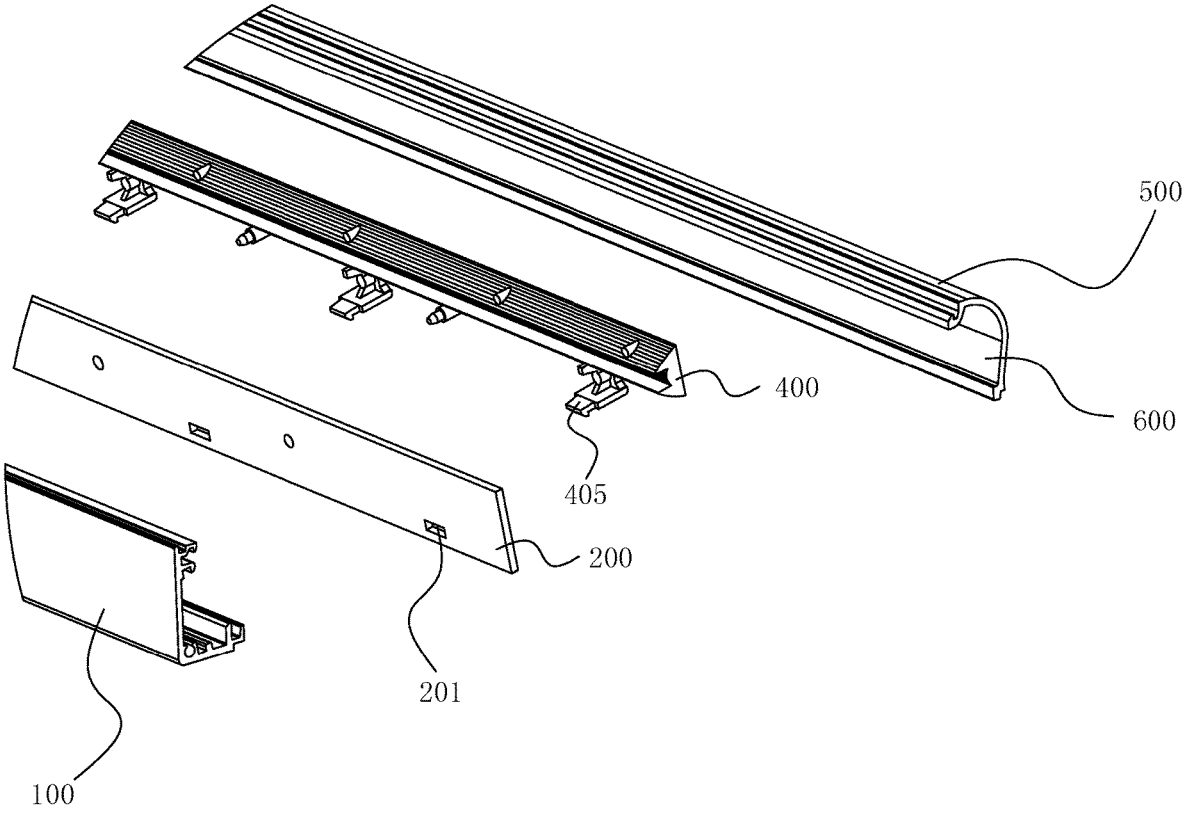
FIG. 7 is an explosive diagram of a high-efficiency linear light source focused strip lamp for another embodiment of the present invention.

As shown in FIG. 6 and FIG. 7, in another embodiment, The strip reflective portion 600' and the strip lamp cover 500 are molded and manufactured by a two-color extrusion process. That is, part of the strip lamp cover 500 is set to be white to reflect some light leakage. At this time, it is necessary to set a buckle 405 on the condensing lens 400 as a fastener to be fixedly connected with the strip lamp plate 200, and the strip lamp plate 200 is provided with a matching connection hole 201.

The above are only preferred embodiments of the present invention, and are not used to limit the protection scope of the present invention. Any modification, equivalent replacement or improvement within the spirit of the present invention is covered by the scope of the claims of the present invention.

What is claimed is:

1. A high-efficiency linear light source focused strip lamp, comprising a strip lamp frame (100), a strip lamp plate (200), provided on the strip lamp frame (100), and a plurality of light-emitting chips (300) disposed at intervals in the longitudinal direction are provided on it;

a condensing lens (400), arranged above the light emitting direction of the light-emitting chip (300), and the light emitting angle of the light-emitting chip (300) is reduced in the plane of the vertical length direction;

and a strip lamp cover 500, connected to the strip lamp frame (100) and is located above the condensing lens (400);

wherein, the strip lamp cover (500) is provided with a convex lens array (501) that visually stretches the light-emitting chip (300) along a lengthwise direction;

one side of the condensing lens (400) away from an irradiation surface is provided with a strip reflective portion (600) that reflects a light leakage to an opposite side of the condensing lens (400), the strip reflective portion (600) is arranged between the strip lamp plate (200) and the strip lamp cover (500);

one side of the strip reflective portion (600) toward the condensing lens (400) is provided with a card slot (601), and the condensing lens (400) is provided with a block (401) that cooperates with the card slot (601).

2. The high-efficiency linear light source focused strip lamp as claimed in claim 1, wherein, a cross section of the strip lamp cover (500) is a curved shape, and each convex lens in the convex lens array (501) is a strip-shaped lens extending along the curved shape.

3. The high-efficiency linear light source focused strip lamp as claimed in claim 2, wherein the condensing lens (400) is a strip lens.

4. The high-efficiency linear light source focused strip lamp as claimed in claim 3, wherein the condensing lens (400) comprises total reflection surfaces (402) provided on both sides of the condensing lens (400) and a light inlet surface (403) and a light outlet surface (404) disposed between the two total reflection surfaces (402).

5. The high-efficiency linear light source focused strip lamp as claimed in claim 1, wherein the convex lens array (501) is disposed on an inner surface or outer surface of the strip lamp cover (500).

6. The high-efficiency linear light source focused strip lamp as claimed in claim 1, wherein the strip reflective portion (600) comprises a white reflective surface.

7. The high-efficiency linear light source focused strip lamp as claimed in claim 1, wherein the strip reflective portion (600') and the strip lamp cover (500) are molded and manufactured by a two-color extrusion process.

8. The high-efficiency linear light source focused strip lamp as claimed in claim 1, wherein the condensing lens (400) is a strip lens.

9. The high-efficiency linear light source focused strip lamp as claimed in claim 1, wherein the condensing lens (400) is a strip lens.

10. The high-efficiency linear light source focused strip lamp as claimed in claim 8, wherein the condensing lens (400) comprises total reflection surfaces (402) provided on both sides of the condensing lens (400) and a light inlet surface (403) and a light outlet surface (404) disposed between the two total reflection surfaces (402).

* * * * *